US005363509A

United States Patent [19]

Evans

[11] Patent Number: 5,363,509

[45] Date of Patent: Nov. 15, 1994

[54] PINCH RESISTANT CHILD'S TOILET SEAT INSERT

[76] Inventor: Hank A. Evans, 106½ Elk, Crosby, Tex. 77532

[21] Appl. No.: 52,907

[22] Filed: Apr. 27, 1993

Related U.S. Application Data

[63] Continuation-in-part of Ser. No. 749,212, Aug. 23, 1991, abandoned.

[51] Int. Cl.[5] ..... A47K 13/06

[52] U.S. Cl. ..... 4/235

[58] Field of Search ..... 4/235, 237, 239

[56] References Cited

U.S. PATENT DOCUMENTS

| | | | |
|---|---|---|---|
| 557,780 | 4/1896 | Dutro | 4/235 |
| 1,894,387 | 1/1933 | Weis | 4/239 |
| 2,255,272 | 9/1941 | Rasmussen | 4/239 |
| 2,693,602 | 11/1954 | Meath | 4/235 |

FOREIGN PATENT DOCUMENTS

| | | | |
|---|---|---|---|
| 0454532 | 1/1928 | Germany | 4/235 |
| 0513314 | 11/1930 | Germany | 4/239 |

*Primary Examiner*—Charles E. Phillips
*Attorney, Agent, or Firm*—James L. Jackson

[57] ABSTRACT

A pinch resistant toilet seat insert is provided for use in combination with conventional toilet seats to restrict the dimension of the opening thereof to facilitate safe and effective use by children. A seat insert body forms an outer peripheral recess at the sides thereof or at the sides and rear portions thereof for supported and positioned engagement with the inner peripheral portion of a conventional toilet seat. The forward side edge portions of the seat insert body are relieved so as to locate the frontal contact points of the insert and the conventional toilet seat so as to be virtually inaccessible to the tissues of the child and to thus minimize the possibility of pinching the child during use. The seat insert body forms outer peripheral channels to conduct accidentally spilled liquid between the seat insert body and the conventional toilet seat so that it will drain into the toilet. The seat insert is of rigid uni-body design and is provided with hinges that establish pivotal connection with the hinge assembly of the conventional toilet seat or with other structure.

19 Claims, 4 Drawing Sheets

FIG. 4
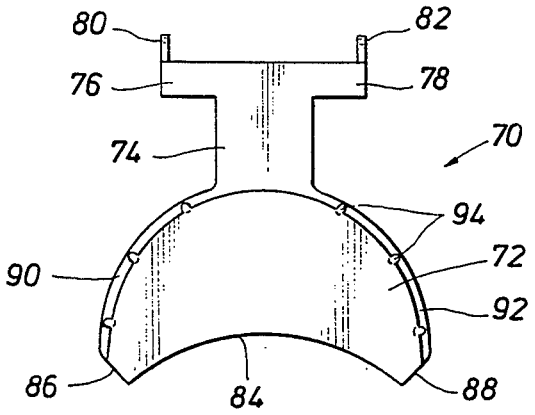
FIG. 5
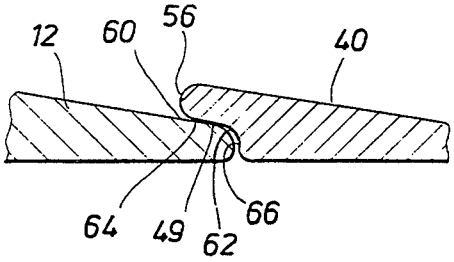
FIG. 6
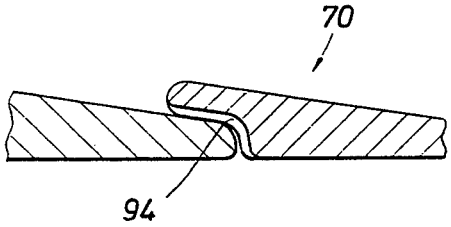
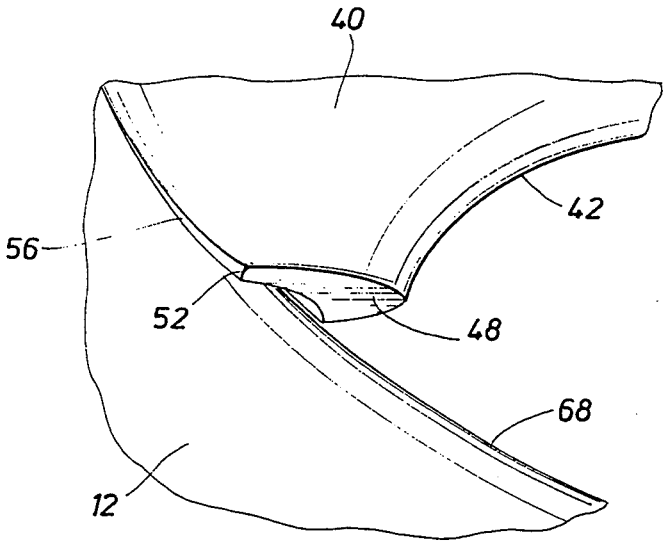
FIG. 7

PINCH RESISTANT CHILD'S TOILET SEAT INSERT

This is a continuation-in-part of application Ser. No. 07/749,212 of Hank A. Evans, filed on Aug. 23, 1991, now abandoned, and entitled Pinch Resistant Child's Toilet Seat.

FIELD OF THE INVENTION

This invention relates generally to toilet seat assemblies including the seats and covers thereof that are typically assembled to ceramic toilets for use in the domestic or commercial environment. More particularly, the present invention is directed to a pinch resistant toilet seat insert for use in combination with conventional toilet seats to restrict the dimension of the opening thereof to facilitate safe and effective use by children and which may be pivotally moved to a position facilitating use of the conventional toilet seat by adults.

BACKGROUND OF THE INVENTION

In most cases domestic and commercial bath facilities utilize toiletry apparatus that is designed particularly for use by adults. Children are often injured in attempting to utilize toilet seat apparatus that is much too large for them. Additionally, the large size of conventional toilet seat apparatus makes it difficult for children to maintain effective sanitary conditions through use thereof because of the difficulty of positioning themselves with relation to the toilet seat and to utilize toilet paper for proper hygienic cleaning. Accordingly, it is considered desirable to provide toilet seat assemblies of conventional design with movable inserts that permit toilets to be effectively utilized by both adults and children. A number of toilet seat inserts have been developed in the past, but for the most part these are of fairly complex and expensive nature. It is desirable to provide a toilet seat insert that provides for effective and reliable use of toilet seat assemblies by children and yet which may be obtained at reasonably low cost.

Removable toilet seat inserts have been provided for children that simply rest on the toilet seat and provide a seat structure design particularly for use by children. These devices are typically formed of molded polymer material and are seldom sufficiently durable for effective use over a long period of time. Moreover, many toilet seat assemblies for children are not particularly stable when in assembly with a conventional toilet seat and thus can move about to some degree. This factor causes many child's toilet seats to be susceptible to pinching the child as the apparatus is used. It is therefore desirable to provide a child's toilet seat assembly that provides effective resistance to pinching during use. It is also desirable to provide toilet inserts that ensure against contamination of toilet seat covers under circumstances where the inserts may have become soiled through use thereof by a child. It is further desirable to provide a child's toilet seat insert that does not interfere with drainage of accidentally spilled liquid to and through the opening of a conventional toilet seat.

SUMMARY OF THE INVENTION

It is a principle feature of the present invention to provide a novel seat insert that may be placed in pivotal assembly with conventional toilet seat structures and which may permit use of the toilet seat assembly by both adults and children.

It is another important feature of this invention to provide a novel seat insert that is designed to position contact areas between the seat insert and the conventional toilet seat so as to be relatively inaccessible to thus minimize the possibility of pinching during use.

It is an even further feature of this invention to provide a novel seat insert for conventional toilet seats that is designed to channel accidentally spilled liquids between the seat insert and the conventional seat for channeled drainage of the liquid into the toilet.

It is an even further feature of this invention to provide a novel pinch resistant toilet insert having a hinge assembly enabling the toilet seat insert to be pivotally connected to the conventional hinge assembly of the toilet seat.

It is also a feature of this invention to provide a novel pinch resistant toilet seat insert having positioning control that limits pivotal movement of the sat insert to a position preventing contact between the toilet seat insert and the cover of the conventional toilet seat to thus maintain the sanitary condition of the conventional toilet seat assembly.

These and other features of the present invention are effectively realized according to the teachings of the present invention through the provision of a toilet seat insert having a seat insert body forming one or more under-side channels or recesses that establish supported and positioning engagement of the insert with a conventional toilet seat whether of the oval domestic variety or of the split commercial variety. The seat insert body is provided with an elongate web or tail piece having hinge connection elements at the free extremity thereof which are adapted to be received by the conventional hinge assembly of the toilet seat or which establish pivotal connection of the seat insert with other structure of the toilet or toilet seat. Thus, the seat insert of the present invention may be effectively utilized with most conventional toilet seat assemblies of both the domestic and commercial variety.

To minimize the possibility of pinching during use by children, the forward portions of the seat insert body define relief at each side thereof which positions the frontal contact area between the sat insert and the conventional toilet seat at a recessed location that is virtually inaccessible by a child seated thereon. Relief against the possibility of pinching may also be provided at the sides and rear of the insert.

The seat insert structure may be provided with a position locator such as a locator projection or a curved tail piece such that at its maximum rearward position, the seat insert will be disposed in spaced relation with a conventional toilet seat cover, thus preventing the toilet seat cover from becoming soiled or otherwise contaminated by contact with the toilet seat insert.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

In the Drawings

FIG. 1 is a plan view of a toilet seat assembly including a conventional toilet seat and toilet seat cover and with a child's toilet seat insert constructed in accordance with the present invention being disposed in pivotal assembly therewith.

FIG. 2 is a sectional view taken along line 2—2 of FIG. 1.

FIG. 3 is a sectional view taken along line 3—3 of FIG. 2.

FIG. 4 is a bottom view of the toilet seat insert of FIG. 1.

FIG. 5 is a fragmentary sectional view of the toilet seat assembly of FIGS. 1—4 illustrating the interfitting supported relation between the inner peripheral portion of a conventional toilet seat and the outer peripheral portion of the toilet seat insert.

FIG. 6 is a fragmentary sectional view similar to that of FIG. 5 and illustrating one of the drain channels of the toilet seat insert for drainage of liquid between the conventional toilet seat and the toilet seat insert.

FIG. 7 is a partial isometric illustration of the conventional toilet seat and toilet seat insert illustrating the relieved forward portion of the toilet seat insert which minimizes the possibility of pinching.

FIG. 8 is a side view of a toilet and toilet seat assembly with part thereof shown in section and illustrating a child's toilet seat insert in assembly therewith which is shown lowered in full line and raised in broken line.

FIG. 9 is a partial isometric illustration of a seat insert representing an alternative embodiment of this invention and including a positioning stop.

FIG. 10 is an elevational view of a toilet showing the seat insert of this invention in assembly therewith, and showing the lowered position of the seat insert in full line and the raised position of the seat insert in broken line.

DETAILED DESCRIPTION OF PREFERRED EMBODIMENT

Figure 1:
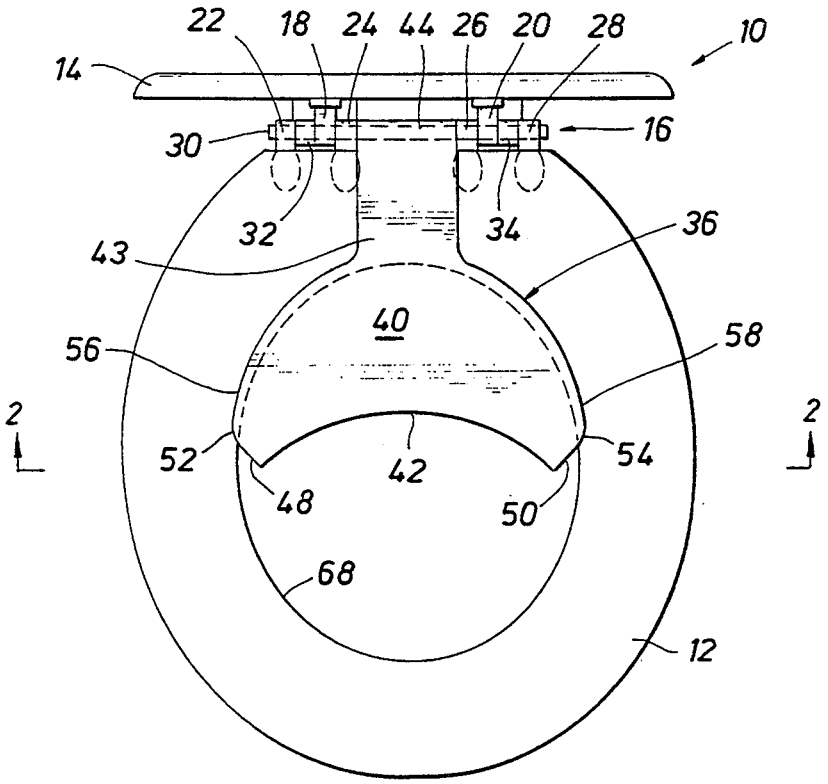

Referring now to the drawings and first to FIG. 1, there is shown a conventional toilet seat assembly generally at 10 incorporating a toilet seat 12 and a toilet seat cover 14 that are assembled by means of a hinge assembly illustrated generally at 16. Hinge fittings 18 and 20 are secured by screws or by any other appropriate means to the inner surface of the toilet seat cover 14. Hinge projections 22, 24, 26 and 28 are connected by screws or by any other suitable means in assembly with the underside of the toilet seat 12. A hinge pin 30 extends through registering openings of the respective hinge projections, thus permitting the toilet seat 12 and the toilet seat cover 14 to be disposed in hinged assembly. The hinge pin 30 also extends through hinge openings defined by a pair of hinge connections 32 and 34 that are secured in fixed assembly with a ceramic toilet structure. Thus, the toilet seat 12 is pivotally connected by the hinge pin 30 to the ceramic toilet.

Figure 2:
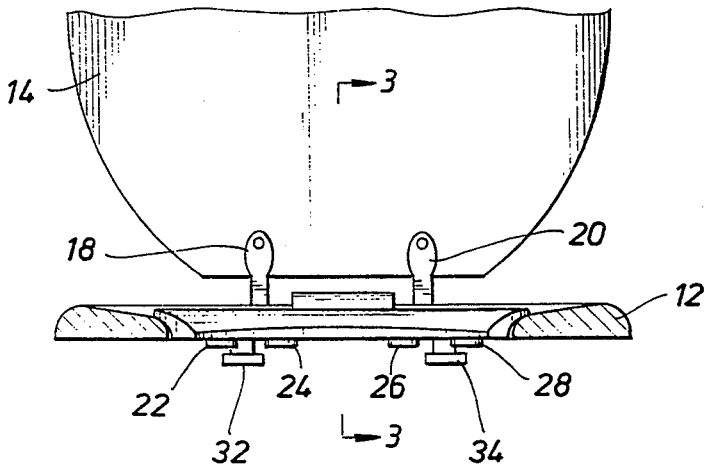
Figure 3:
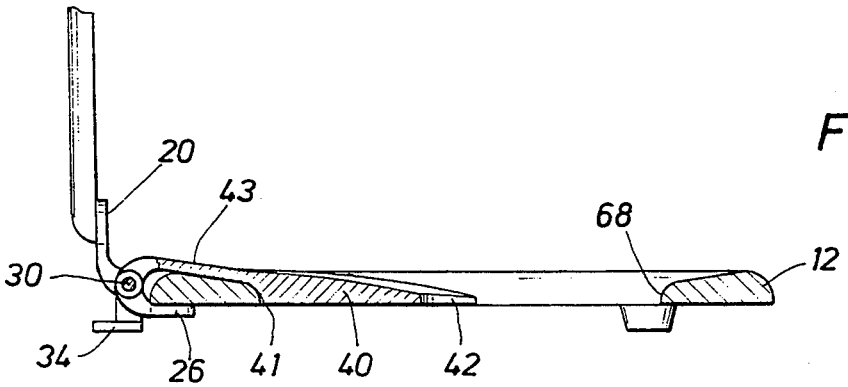

As mentioned above, it is desirable to provide means for reducing the dimension of the opening of the conventional toilet seat 12 by covering a rear portion of the toilet seat by means of a pivotal insert to thus permit efficient, safe and effective sanitary use of the toilet by children. It is also desirable to provide means for assembly with a conventional toilet seat and being pivotal between raised and lowered positions relative thereto. The seat insert effectively closes a rear portion of the opening of the conventional toilet seat and facilitates its use by children. The insert defines angulated side surfaces which have angulated intersection with the inner peripheral surface of the seat opening when the seat insert is at its lowered position. It is further desirable to insure effective channeling of accidentally spilled liquid from the toilet seat apparatus and into the toilet and to minimize the possibility of contamination of the toilet seat cover as the dimension reducing means is moved out of the way to permit use of the toilet seat by an adult. One suitable means for accomplishing these desired features may conveniently take the form illustrated particularly in FIGS. 1–7 which present, generally at 36, a toilet seat insert structure that is positionable in supported and stabilized relation with a conventional toilet seat as shown in FIGS. 1–3 to overlie a portion of the conventional toilet seat opening 38 and which is also selectively positionable to permit effective use of the conventional toilet seat 12 by adults.

The toilet seat insert 36 is adapted for efficient use with most toilet seats whether the upper surface thereof be rounded or substantially flat and inclined or tapered because the insert establishes supported engagement only with the inner peripheral surface portion of the toilet seat. The toilet seat insert structure 36 is defined by an insert body having a configuration for substantially closing the rear portion of the toilet seat opening 38 and forming a broad, smoothly curved front edge 42 which, in the embodiment of FIG. 1 is shown to have a fairly large radius of curvature to provide for effective stabilization of a child seated on the toilet seat assembly. Although the upper surface of the insert body 40 may be of substantially planar configuration throughout most of its front to rear width, it may take other suitable forms such as a gently curved or contoured configuration, for example, to permit the comfort of the child during use. Further, although the front edge 42 is shown to be of arcuate configuration defining a rather large radius of curvature, it may take other suitable forms to provide for stability of the child user without departing from the spirit and scope of the present invention. Additionally, the insert body 40 may be tapered from a thick dimension at its rear portion 41 to a less thick dimension at the front edge 42. This feature enhances the ability of the children to properly position themselves with respect to the reduced dimension of the seat opening 38.

To provide for pivotal connection of the toilet seat insert structure 36 to the hinge assembly of the toilet seat, an integral connection web or tail piece 43 projects rearwardly from the seat insert body 40 and defines a hinge connection 44 that is adapted to receive the hinge pin 30 so as to render the toilet seat insert 36 pivotal about the hinge pin. The web or tail piece will overlie the rear portion of the toilet seat and may be of a straight or curved configuration as the case may be, conforming to the configuration of the upper surface of the toilet seat with which it is to be used. This feature permits the toilet seat insert to be positioned as shown in FIGS. 1–3 for effective use by children, or to be pivoted upwardly and out of the way for use of the toilet seat by adults. The hinge connection 44 may be in the form of an elongate bore defined in the rear portion of the tail piece 43 as shown by broken lines in FIG. 1 or, in the alternative, the hinge connection may take any of a number of different forms that is suitable to the particular design of the toilet seat assembly to which it is pivotally connected.

It is to be noted that the scope of this invention is not intended to be limited by the particular hinge construction that is employed for pivotal support of the child's toilet seat insert. Any suitable hinge structure may be employed to support and position the toilet seat insert, whether the hinge be a part of the conventional toilet seat assembly or whether it be specific to establish pivotal connection of the toilet seat insert to other structure of the toilet. For example, the toilet seat insert may be pivotally supported and positioned by a hinge assembly separate from the hinge assembly of the toilet seat. In the alternative, the toilet seat insert may be free from any structural connection with the toilet assembly and may be supported and positioned merely by its structurally interfitting relation with the toilet seat.

It is desirable to provide a toilet seat insert of the character described and which also when lowered, covers a rear potion of the conventional toilet seat opening to facilitate safe and effective use of the toilet by a child. According to the teachings of this invention, the front, side portions of the seat insert 40 are angulated so as to provide opposed side surfaces 48 and 50 that are disposed in rearwardly diverging relation and which establish a smooth radius of curvature as shown in 52 and 54 at the juncture thereof with curved side edges 56 and 58 of the insert. This feature is also illustrated by way of the partial isometric view of FIG. 7. By angulating the side surfaces 48 and 50 in this manner the initial forward contact point 51 between the seat insert 40 and the upper surface of the toilet seat 12 will be at a recessed or protected location by virtue of being located rearwardly of the spaced forwardly-extending pointed regions 53 and 55 of the seat insert. Thus the forwardly-extended pointed regions 53 and 55 of the seat insert are located in laterally spaced relation with the inner curved edge 68 of the toilet seat. This causes the development of a triangular space or void 57 which makes the initial contact point 51 on each side of the seat insert to be located rearwardly of the point of intersection that would be established if the curvature of forward edge 42 were continued to intersection with the curved edge 68 of the toilet seat. This recessed or protected location of the contact point 51 is cooperatively defined by the intersecting orientation of the rearwardly diverging angulated side surfaces 48 and 50 with the inner curved surface of the toilet seat and the spaced location of the upper surface of the seat insert above the upper surface of the toilet seat. As shown in FIG. 1 elongate narrow contact areas are established at each of the sides of the seat insert with respect to the toilet seat surface 60 adjacent the curved inner edge surface 68 of the toilet seat. The recessed or protected location of the forward contact points 51 is also ensured by the structural relationship of the curved side edges 56 and the support surface 64 with the upper surface 60 of the toilet seat. Additionally, the curved side edges are rounded as is evident from FIGS. 5–7 so that the contact areas of these curved edges, with the toilet seat insert in supported engagement with the toilet seat, are recessed or set back, as shown at 49 from the forward portions 53 and 55. In essence, therefore, the relationship of the angulated surfaces 48 and 50 with the inner curved surface 68 of the seat 12 locates the initial portion of contact area 49 of the support surface 64 with the seat surface 60 from the forward contact points 51 rearwardly, at a recessed and substantially inaccessible location, with respect to the forwardly extending side portions of the insert. Because of this recessed location of the initial insert portion of the contact areas 49 it is unlikely that the body tissues of the child can become located between the seat and seat insert at these contact points. Further, at the curved juncture of the side edges 56 and 58 with the toilet seat, as shown in FIG. 5, the initial line or area of contact of the seat insert 40 with the upper surface of the toilet seat 12 will also be located in recessed manner by the structural relationship of the curved side edge 56 with the toilet seat surface 60.

It is desirable that the seat insert body 40 establish support and positioning with respect to the toilet seat 12 such that it is substantially immovable with respect to the toilet seat when positioned as shown in FIG. 1. To accomplish this feature, side and rear edge portions of the seat insert 40 are relieved to form a downwardly directed recess 62 defining a downwardly directed support surface 64 to establish supported engagement with the upper surface of the toilet seat 12 immediately about the curved inner surface 68 thereof and to form an outwardly directed locator surface or shoulder 66 that is adapted to be received in close fitting relation with the inner curved surface 68 that defines the toilet seat opening 38. The shoulder surface 66, when properly positioned relative to the inner curved surface 68 of the toilet seat, may be slightly spaced therefrom as shown in FIG. 5. The shoulder surface 66 will contact the curved surface 68 of the toilet seat upon minimal lateral shifting of the insert. Thus the shoulder surface 66 minimizes lateral shifting of the seat insert 40 with respect to the toilet seat 12 to insure lateral stability of the toilet seat insert when in supported engagement with the toilet seat. Though slight lateral movement of the toilet seat insert relative to the toilet seat is permissible, the shoulder surfaces 66 will contact the inner surface of the toilet seat to minimize the amount of actual movement of the insert. The support surface 64 establishes efficient and stable support with the upper surface of the toilet seat 12 to further insure the stability of the insert with respect to the toilet seat. Additionally, the tail piece 74, being rather wide, provides the seat insert with efficient structural integrity and also assists in minimizing lateral shifting of the seat insert when it is in supported engagement with the toilet seat.

As mentioned above, it is desirable to provide for channeling of accidentally spilled liquid between the toilet seat and toilet seat insert and through the toilet seat opening into the toilet. This feature is accomplished by providing the insert with drainage channels as shown by the bottom view of FIG. 4 and as shown by the partial sectional view of FIG. 6. This feature may be provided in the embodiment of FIG. 1 and is shown in an alternative embodiment of this invention which is illustrated generally at 70 in FIGS. 4 and 6. The toilet seat insert structure 70 defines an insert body 72 that is of quite similar form and construction as compared with the seat insert body 40 shown in FIGS. 1–3. the seat insert body 72 defines a web or tail piece 74 having transverse extensions 76 and 78 that provide pivotal connections 80 and 82 respectively. These pivotal connections each form apertures that receive the pivot pin or pins of a particular toilet seat assembly so as to establish pivotal connection of the seat insert body with the toilet seat assembly. The seat insert body 72 also forms a curved forward edge 84 and rearwardly diverging side relief surfaces 86 and 88 that are of substantially the same as compared to the edge 42 and the diverging side relief surfaces 48 and 50 as shown in FIG. 1.

The bottom view of FIG. 4 illustrates curved side recesses 90 and 92 that are of similar configuration as compared to the recess 62 shown in the fragmentary sectional view of FIG. 5. The recesses 90 and 92 form support and locator surfaces in the same manner as discussed above in connection with FIG. 5. The seat body insert 72 is formed with a plurality of transversely oriented channels 94 that are positioned in spaced relation about the side and rear curvature of the seat insert. One of these transversely oriented liquid drain channels is illustrated in the fragmentary sectional view of FIG. 6. In the event liquid is accidentally spilled on the upper surface of the toilet seat 12, it is typically directed toward the opening 38 of the toilet seat by the slope or curvature of the upper toilet seat surface. The drain channels 94 permit this accidentally spilled liquid to flow between the seat insert and the toilet seat and through the toilet seat opening 38 into the toilet for disposal. This feature minimizes soiling of the toilet seat and enhances the sanitary condition of the toilet.

Figure 8:
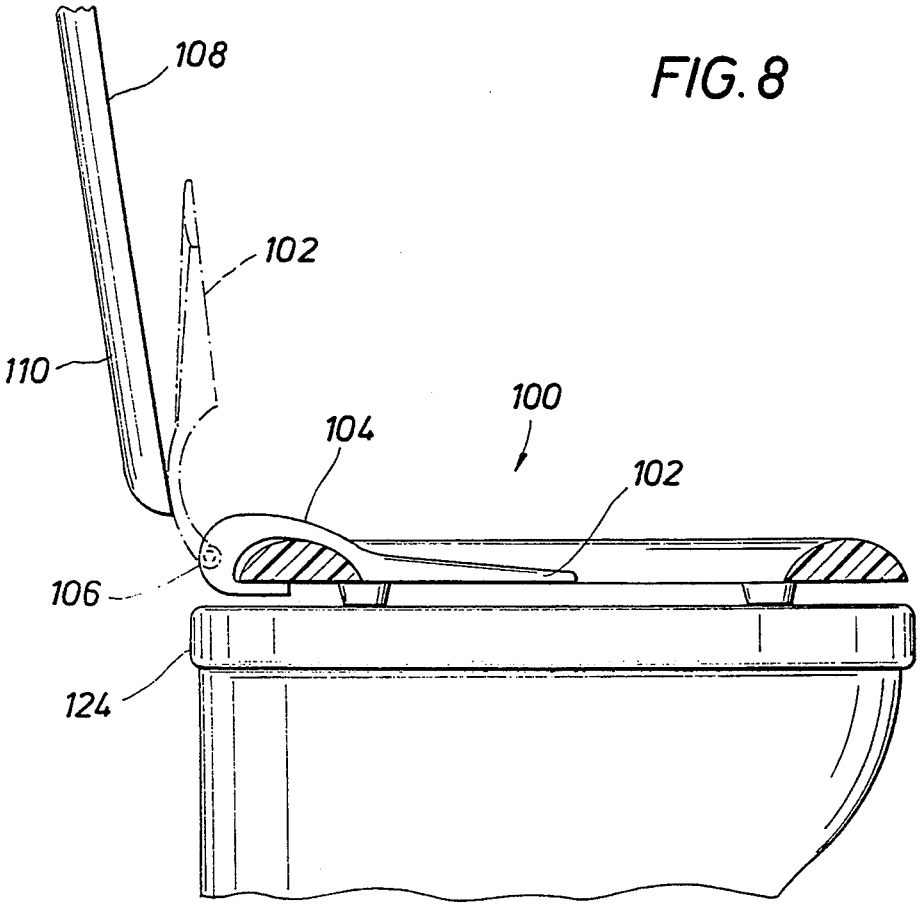

In view of the fact that the toilet seat insert is intended to be utilized by children of all ages, especially those that are being "potty trained" it is likely that the toilet seat insert will become soiled from time to time. As mentioned above, it is desirable that the cover for the conventional toilet seat be protected against accidental soiling. According to the scope of the present invention, this feature is effectively realized by providing a toilet seat insert defining stop means for engagement with the toilet seat cover or with the ceramic toilet and which limits rearward pivoting of the toilet seat insert so that the seat insert cannot come into contact with the toilet seat cover when the toilet seat insert is at its raised position. One suitable embodiment for accomplishing this feature may conveniently take the form shown in FIG. 8 where a toilet seat insert is provided as shown generally at 100 having a seat body structure 102 that may be essentially identical with the seat body structures shown at 40 and 72. From the seat body 102 extends an integral elongate connection web or tail piece 104 having a curved configuration and having pivot connection means 106 of any suitable character located at the free extremity thereof. At the raised position of the insert structure 100 the curved web or tail piece 104 will contact the inner surface 108 of the toilet seat cover 110 thereby providing a stop function to limit rearward pivoting of the insert. At its raised and stopped position as shown in FIG. 8, the curved tail piece 104 will prevent contact of the toilet seat insert with the inner surface 108 of the toilet seat cover. This feature effectively prevents soiling of the toilet seat cover in the event the toilet seat insert should be soiled.

Figure 9:
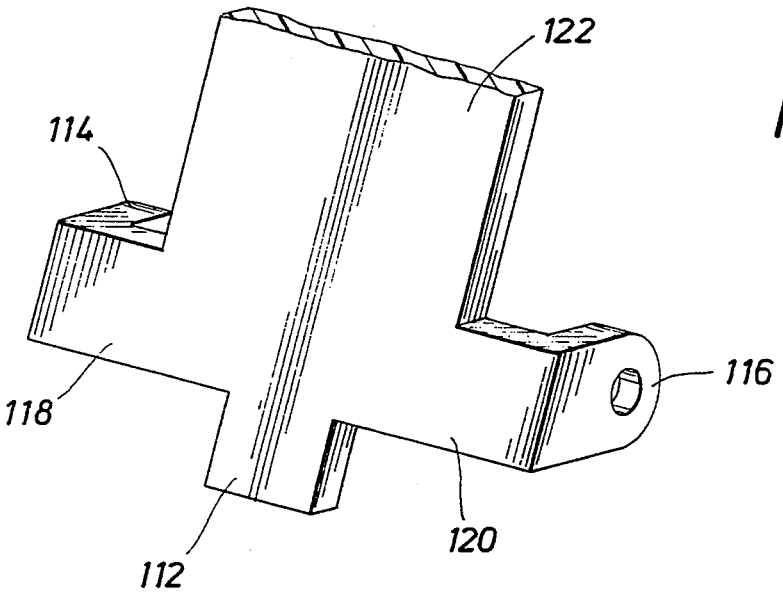
Figure 10:
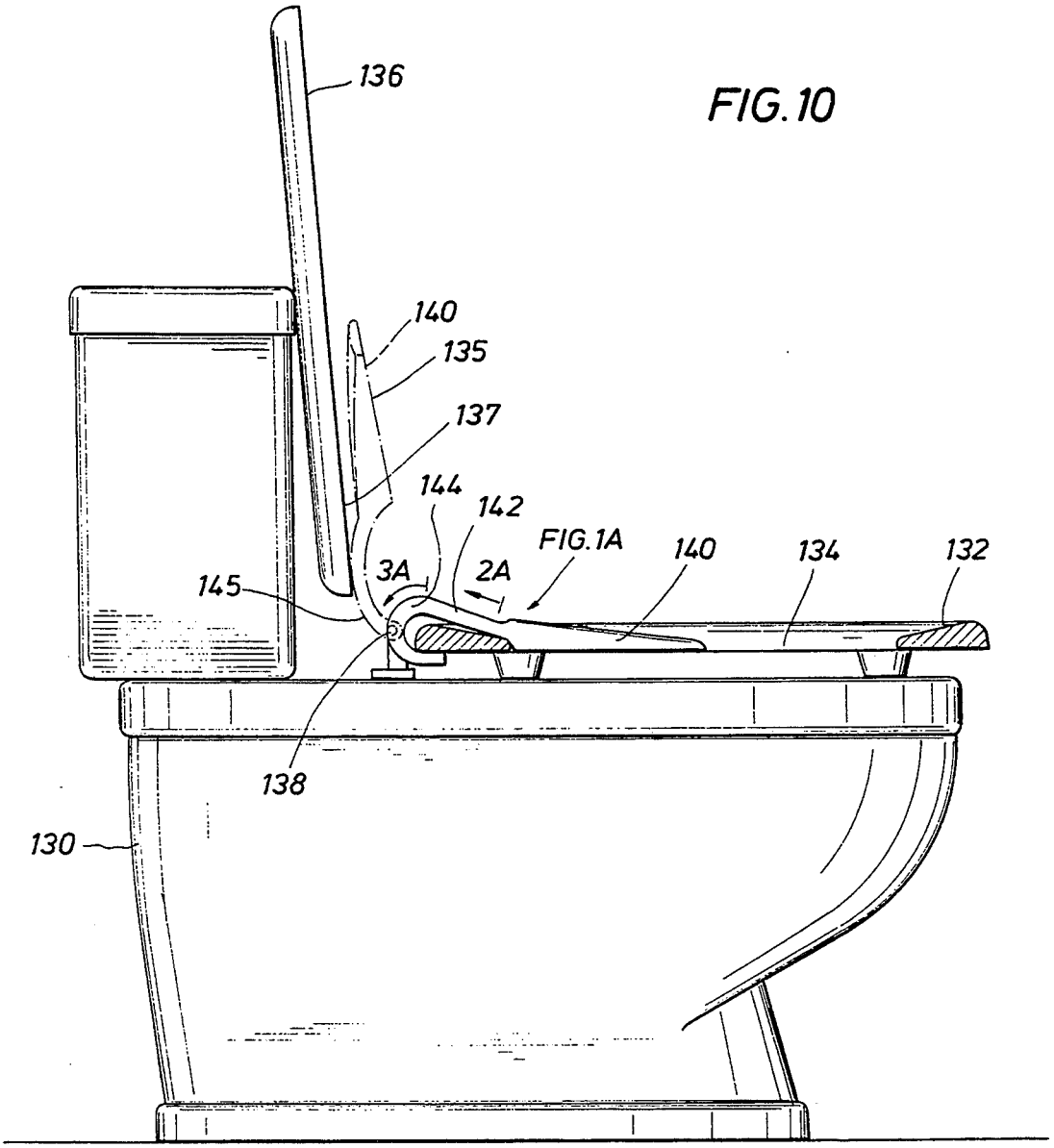

As shown by FIG. 9, the positioning stop for limiting rearward pivotal movement of the toilet seat insert and for insuring against soiling of the toilet seat cover may conveniently take the form of a stop tab or projection 112 that extends rearwardly beyond the pivot connection portions 114 and 116 that are formed by transversely extending projections 118 and 120 of the connection web 122. At the raised position of the toilet seat insert the stop projection will contact the rear portion of the toilet, shown at 124 in FIG. 8, thus limiting further rearward pivoting of the insert. At this raised and stopped position the insert will be disposed in spaced relation with the toilet seat cover as shown in broken line in FIG. 8 and therefore any contamination present on the insert will be prevented from being transferred by contact to the toilet seat cover.

In view of the foregoing, it is evident that the present invention is one well adapted to attain all of the objects and features hereinabove set forth, together with other objects and features which are inherent in the apparatus disclosed herein.

As will be readily apparent to those skilled in the art, the present invention may be produced in other specific forms without departing from its spirit or essential characteristics. The present embodiment, is therefore, to be considered as illustrative and not restrictive, the scope of the invention being indicated by the claims rather than the foregoing description, and all changes which come within the meaning and range of the equivalence of the claims are therefore intended to be embraced therein.

What is claimed is:

1. A pinch resistant toilet seat insert to facilitate safe and effective use by children for use in combination with conventional toilet seats having a hinge and hinge pin assembly for pivotal mounting thereof on a toilet structure and defining an upwardly facing seat surface and an inner curved surface defining a toilet seat opening, said pinch resistant toilet seat insert comprising:

(a) a seat insert body having curved side edges, a front edge and a rear edge and having opposed forwardly extending portions and having an outer supporting edge for interfitting supported engagement with said seat surface of said conventional toilet seat at a location adjacent said inner curved surface, said seat insert further having rearwardly diverging angulated side surfaces extending between said curved edges and said opposed forwardly extending portions, contact between said seat surface and said insert being located inwardly of said curved side edges and extending between contact points at said rearwardly diverging angulated side surfaces, to minimize the possibility of pinching the buttocks or thighs of a child between the toilet seat and toilet seat insert during use, (b) a tailpiece projecting rearwardly from said seat insert body and defining means for pivotally attaching said insert body to said hinge and hinge pin assembly of said conventional toilet seat and enabling said seat insert body to be pivotally moved to said raised position to permit use of said conventional toilet seat by adults and a lowered position in supported assembly with said conventional toilet seat to facilitate use thereof by children.

2. The pinch resistant toilet seat insert of claim 1, wherein:

said curved side edges of said seat insert body define an outwardly directed locator surface disposed adjacent said curved side edges and rear edge for positioning engagement with said inner curved surface of said conventional toilet seat and at said lowered position being received within said opening of said conventional toilet seat to insure positioning and lateral stability of said toilet seat insert when in supported engagement with said conventional toilet seat.

3. The pinch resistant toilet seat insert of claim 2, wherein: said outwardly directed locator surface substantially conforms to the configuration of said inner curved surface of said conventional toilet seat.

4. The pinch resistant toilet seat insert of claim 2, wherein:

said toilet seat insert forms an outer peripheral recess extending about the side and rear portions thereof and disposed to receive said inner curved surface of said conventional toilet seat for support and positioning of said toilet seat insert by said conventional toilet seat.

5. The pinch resistant toilet seat insert of claim 1, wherein said means for pivotally attaching said insert body to said hinge and hinge pin assembly of said conventional toilet seat comprises:

hinge means establishing an insert positioning portion and further defining a pivot axis being so located with respect to said seat insert body and said insert positioning portion that at a raised position said seat insert body being positioned over-center with respect to said pivot axis and being maintained at said raised position by gravitational force, said hinge means being adapted for hinged assembly with said hinge and hinge pin assembly of said conventional toilet seat.

6. The pinch resistant toilet seat insert of claim 1, wherein:

said rearwardly diverging angulated side surfaces having angulated intersection with said inner curved surface of said conventional toilet seat when said seat insert body is positioned in supported relation therewith.

7. The pinch resistant toilet seat insert of claim 1, wherein stop means is defined by said seat insert body and is disposed for stopping engagement with said conventional toilet seat or other toilet structure to limit rearward pivotal movement of said seat insert body at said raised position thereof to thus prevent contact between said seat insert body and a toilet seat cover of said conventional seat.

8. The pinch resistant toilet seat insert of claim 7, wherein said stop means comprises:

a stop projection extending rearwardly from said seat insert body and being disposed for stopping contact with said conventional toilet seat or other toilet structure.

9. The pinch resistant toilet seat insert of claim 8, wherein:

said positioning stop projection extends rearwardly from said tailpiece and is oriented downwardly for contact with said conventional toilet seat or other toilet structure when said seat insert is at said over-center raised position.

10. The pinch resistant toilet seat insert of claim 7, wherein:

said stop means is defined by said tail piece of said seat insert body.

11. The pinch resistant toilet seat insert of claim 1, wherein:

said tail piece of said seat insert body is of a configuration that, upon rearward pivotal movement of said seat insert body, said tail piece comes into stopping contact with the cover of said conventional toilet seat at a position where said seat insert body is disposed in spaced relation with said toilet seat cover.

12. The pinch resistant toilet seat insert of claim 1, wherein:

said seat insert body forms at least one drain channel in the lower surface thereof to permit liquid accidentally spilled on said conventional toilet seat to drain between said insert body and said conventional toilet seat to the opening of said conventional toilet seat.

13. The pinch resistant toilet seat insert of claim 1, wherein:

said seat insert body forms a plurality of drain channels at said outer supporting edge means thereof for channeling accidentally spilled liquid between said seat insert body and said conventional toilet seat to the opening of the conventional toilet seat.

14. The pinch resistant toilet seat insert of claim 1, wherein:

said tailpiece defines stop means for engagement with said conventional toilet for positioning said toilet seat insert in spaced relation with said toilet seat cover when said toilet seat insert is at said raised position thereof.

15. The pinch resistant toilet seat insert of claim 14, wherein said stop means comprises:

an upwardly and rearwardly projecting portion of said tailpiece being oriented for stopping engagement with said toilet seat cover when said toilet seat insert is at said raised position thereof.

16. The pinch resistant toilet seat insert of claim 1, wherein:

said curved side edges of said seat insert body define an outwardly directed locator surface disposed for positioning engagement with said inner curved surface of said conventional toilet seat to insure positioning and lateral stability of said toilet seat insert when in supported engagement with said conventional toilet seat.

17. The pinch resistant toilet seat insert of claim 1, wherein:

said outer supporting edge of said insert body defines an outer peripheral recess extending about the side and rear portions of said seat insert body and being disposed to receive said inner curved surface of said conventional toilet seat for support and positioning of said seat insert body by said conventional toilet seat.

18. The pinch resistant toilet seat insert of claim 1, wherein:

said outer supporting edge of said seat insert body defines a downwardly directed support surface for supported engagement with said seat surface of said conventional toilet seat and defining an outwardly directed locator surface substantially conforming to the dimension and configuration of said inner curved surface of said conventional toilet seat for stable support and positioning of said seat insert body relative to said conventional toilet seat.

19. The pinch resistant toilet seat insert of claim 1, wherein:

said tailpiece of said seat insert body being of curved configuration and being disposed for positioning engagement with a pivotal toilet seat cover of said conventional toilet seat to limit rearward pivotal movement of said seat insert body to thus prevent contact between said seat insert body and a said toilet seat cover of said conventional seat.

* * * * *